US011553750B2

(12) United States Patent
Henning

(10) Patent No.: US 11,553,750 B2
(45) **Date of Patent: *Jan. 17, 2023**

(54) HAT WITH BENDABLE BRIM

(71) Applicant: Christopher Damien Henning, Larkspur, CO (US)

(72) Inventor: Christopher Damien Henning, Larkspur, CO (US)

( * ) Notice: Subject to any disclaimer, the term of this patent is extended or adjusted under 35 U.S.C. 154(b) by 104 days.

This patent is subject to a terminal disclaimer.

(21) Appl. No.: 17/014,456

(22) Filed: Sep. 8, 2020

(65) Prior Publication Data

US 2020/0397084 A1 Dec. 24, 2020

Related U.S. Application Data

(63) Continuation of application No. 16/072,121, filed as application No. PCT/US2017/060185 on Nov. 6, 2017, now Pat. No. 10,806,202.

(60) Provisional application No. 62/492,289, filed on May 1, 2017.

(51) Int. Cl.

| | |
|---|---|
| ***A42B 1/0186*** | (2021.01) |
| ***A42B 1/201*** | (2021.01) |
| ***A42B 1/206*** | (2021.01) |
| ***A42B 1/02*** | (2006.01) |
| ***A42B 1/203*** | (2021.01) |
| ***A42B 1/205*** | (2021.01) |
| ***A42B 1/06*** | (2021.01) |

(52) U.S. Cl.

CPC ..... *A42B 1/02* (2013.01); *A42B 1/0186* (2021.01); *A42B 1/06* (2013.01); *A42B 1/201* (2013.01); *A42B 1/203* (2013.01); *A42B 1/205* (2013.01); *A42B 1/206* (2013.01)

(58) Field of Classification Search

CPC ..... A42B 1/20; A42B 1/201; A42B 1/206; A42B 1/003

See application file for complete search history.

(56) References Cited

U.S. PATENT DOCUMENTS

| | | | | |
|---|---|---|---|---|
| D112,724 | S * | 12/1938 | Shell | D2/865 |
| 9,949,520 | B2 * | 4/2018 | Terada | A42B 1/201 |
| 10,806,202 | B2 * | 10/2020 | Henning | A42B 1/0183 |

* cited by examiner

*Primary Examiner* — Katherine M Moran

(74) *Attorney, Agent, or Firm* — Leyendecker & Lemire, LLC

(57) ABSTRACT

A sun hat having a bendable and shapeable brim is described. The bendable brim is characterized by a wire cable assembly secured in the brim of the hat along its perimeter. The wire cable assembly can comprise a loop of multi-strand metal cable enclosed in a slightly oversized flexible plastic sheath that is hermetically sealed at joining ends. The cable can be comprised of an annealed metal that permits it to be bent thousands of times without breaking.

8 Claims, 5 Drawing Sheets

HAT WITH BENDABLE BRIM

RELATED PATENTS/APPLICATIONS

This continuation patent application claims priority to and incorporates by reference: (1) U.S. NSE Non-Provisional patent application Ser. No. 16/072,121 filed on Jul. 23, 2018 (now U.S. Pat. No. 10,806,202); (2) PCT Patent Application PCT/US17/60185 filed on Nov. 6, 2017; and (3) U.S. Provisional Patent Application No. 62/492,289 filed on May 1, 2017. All applications have the same inventor as the present application.

BACKGROUND

Sun hats with wide brims are known. The brims shade all or part of the wearer's face, head and neck minimizing exposure to the rays of the Sun. Sun hats can come in many forms and styles but are most typically comprised of a lightweight crushable crown and a partially stiffened brim that can often be folded or stuffed into a bag for transport when not being worn. Sun hats often also include a chin/neck strap that can be used in windy weather to secure the hat in place on the wear's head. Most typical sun hats emphasize functionality over style and are usually worn at less formal outdoor activities, such as hiking, backpacking, playing outdoor sports, and hanging out at the beach.

The brims on sun hats, even if stiffened, tend to be relatively floppy and often misshapen. They often don't hold their shape when exposed to wind. Further, the wide brims can prove troublesome with back side of the brim interfering with a backpack while hiking or when the front side of the brim interfering when the wearer is trying to take a photo. The weight of rain on the topside of the brim can cause it to collapse sending a wave of water onto the wearer. Washing a typical sun hat and/or crushing it to carry it in a bag or pack also causes the shape and structural integrity of the brim to degrade.

DETAILED DESCRIPTION

Figure 1:
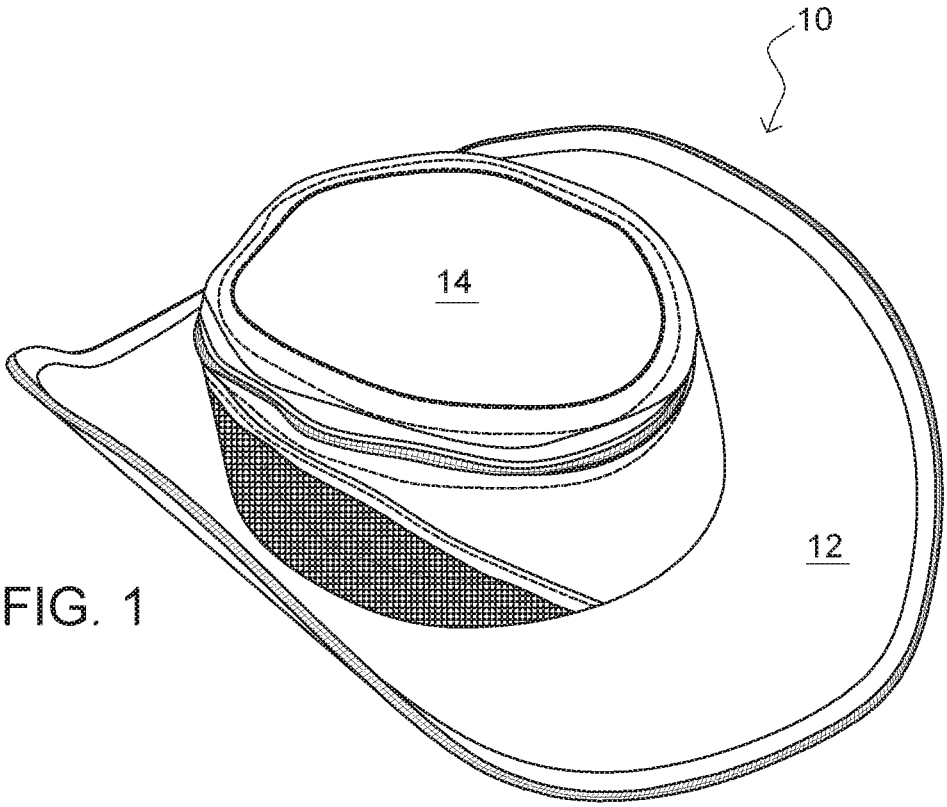
FIG. 1 is a perspective top view of a sun hat according to an embodiment of the present invention.

Embodiments of the present invention comprise a sun hat having a bendable and shapeable brim. Advantageously, the brim can be folded as desired by a wearer to suit his/her style or activity. Further, the bendable brim permits a wearer to fold the hat in half or quarters for storage in a bag or pack. Additional features of embodiments include a crushable crown, machine washability, a stowable neck cover, a removable crown top, an adjustable crown circumference and a chin strap among others.

Embodiments of the invention are characterized by a wire cable assembly secured in the brim of the hat along its perimeter. The wire cable assembly comprises a loop of multi-strand metal cable having a gauge weight of about 8 that is completely enclosed in a slightly oversized flexible polymeric sheath that is hermetically sealed at joining ends. The cable is typically comprised of an annealed metal that permits it to be bent thousands of times without breaking.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

The term "multistrand" as pertaining to wire or cable refers to a wire or cable made of multiple individual strands or filaments of wire that are twisted, braided or otherwise joined together in a bundle.

An Embodiment of a Hat with a Bendable Brim

FIGS. 1-10 illustrate an embodiment of a hat with a bendable brim. The illustrated embodiment is typically referred to as a "sunhat" although it is to be appreciated that the combinations of the various features can be incorporated into other types of hats as well as would be obvious to one or ordinary skill in the art given the benefit of this disclosure.

Figure 2:
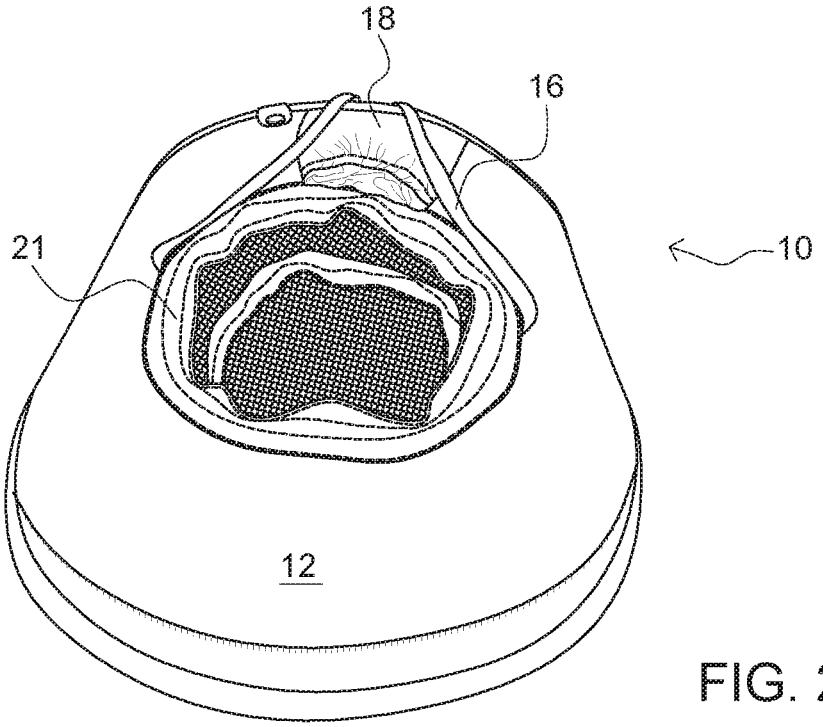
FIG. 2 is a perspective bottom view of the sun hat according to an embodiment of the present invention.

Referring primarily to FIGS. 1 & 2, the hat 10 comprises a brim 12, a crown 14 and a chin strap 16. The crown is of the collapsible variety facilitating the easy packing and storage of the hat. It is typically comprised of a water resistant fabric. The fabric can comprise natural fiber, such as cotton, or synthetic fibers, such as nylon. The fabric can be coated to impart water resistance. Mesh panels can also be provided for breathability.

As shown in FIG. 2, proximate the crown's intersection with the brim, a sweatband 21 is provided. The sweatband is typically sewn to the hat at a bottom edge at the intersection of the crown and brim and extends upwardly therefrom. In at least some embodiments, the upper portion of the sweat band is secured in place at several locations, typically through sewing, so that the band cannot flop outwardly when a wearer removes the hat.

Accessible on the exterior of the crown also proximate the intersection of the brim and crown at the crown's backside, a drawstring 17 that extends around the crown next to and underneath the sweatband can be provided that permits a user to adjust the size of the hat. Advantageously, a wearer can increase the size of the hat if he/she wants to wear the hat over a jacket hood, a winter cap or headband.

Figure 3:
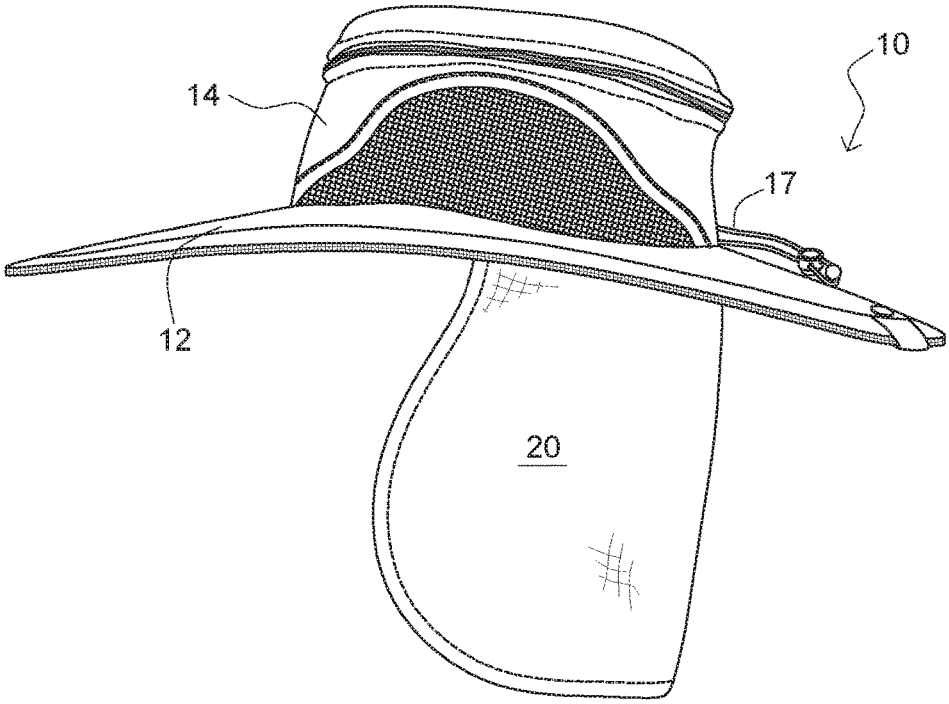
FIG. 3 is a perspective side view of the sun hat showing the neck cover deployed according to an embodiment of the present invention.
Figure 4:
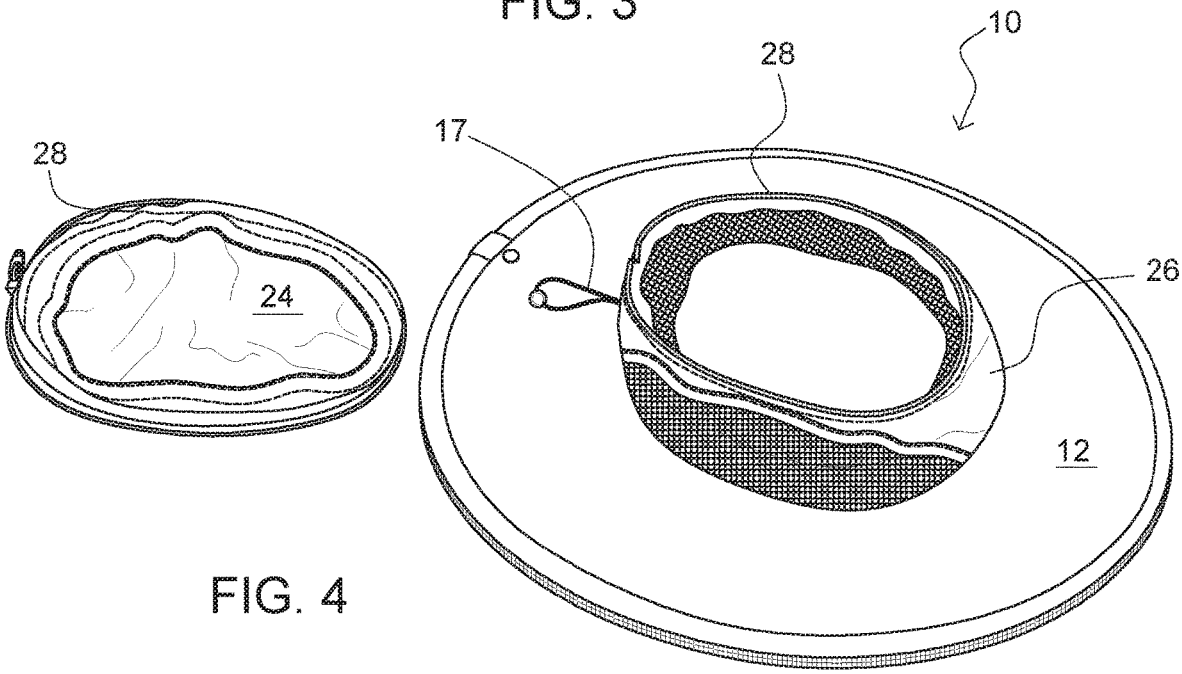
FIG. 4 a perspective top view of the sun hat showing the top of the crown removed according to an embodiment of the present invention.

As shown in FIG. 3, the typically horizontal top portion 24 of the crown 14 is removable from the vertical annular wall 26 thereof permitting a user with long hair to pass his/her hair therethrough while still having the brim of the hat shade the wearer's face from the sun. In the illustrated variation, the top portion is secured to the annular wall by way of a zipper assembly 28. When fully removed, the top portion can be stored in the under brim pocket 18 which is described below. Alternatively, a wearer can unzip the top portion partially without removing it to increase ventilation.

The brim 12 extends outwards from the crown 14 and is typically comprised of top and bottom fabric layers that sandwich a planar core comprised of any suitable material configured to increase the stiffness of the brim and provide support thereto. The core can comprise a dense foam, one or more layers of woven or non-woven fabric, leather or plastic sheet to name a few possibilities. In most variations, the core will comprise a material that can be bent and folded without permanent deformation facilitating the changing of the brim's shape and the folding of the brim for storage. In at least one variation the core material comprises an Ethylene-vinyl acetate (EVA) foam sheet. The top and bottom fabric layers can be secured to the core by any suitable means including sewing and adhesive bonding.

As can also be seen in FIG. 2, an under brim pocket 18 is provided at the back of the hat on the underside of the brim. the pocket serves the primary function of stowing a selectively deployable neck cover 20 or cape. The neck cover is shown deployed in FIG. 3. Typically, a top edge of the cover is sewn to the hat proximate the crown and brim intersection and the remainder is stuffed into the pocket. To deploy the cover is pulled out of the pocket and the edges as desired are further hooked to the left and right sides of hat proximate the brim 12 and crown 14 intersection to drape over the back and sides of the neck while the hat is being worn and provide additional protection of the neck from the sun. The pocket 18 can also be used to hold other small and lightweight items such as a credit card, driver's license and paper money in addition to the top portion 24 of the crown as indicated above.

Figure 7:
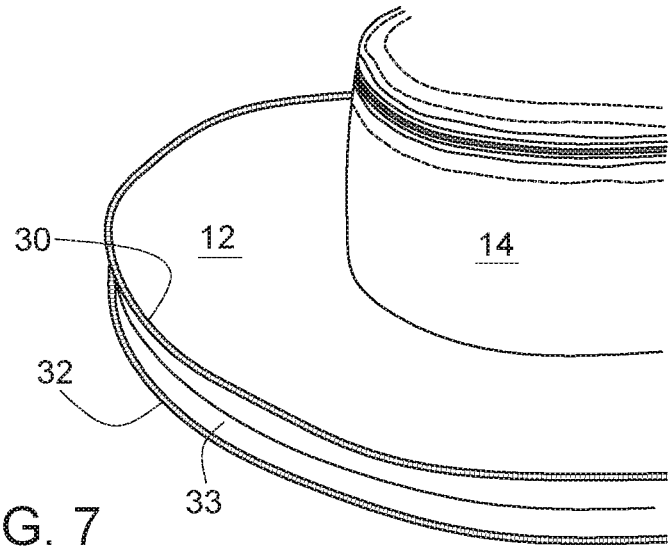
FIG. 7 is a perspective view of the hat showing an unzipped perimeter of the brim wherein the wire cable assembly is received according to an embodiment of the present invention.

Along substantially the entire perimeter of the brim 14, an upper row 30 of zipper teeth are secured to the top fabric layer and a corresponding lower row 32 of zipper teeth are secured to the bottom fabric layer. After fabrication the upper and lower rows are zipped together to enclose a channel 33 around the perimeter of the brim in which a wire cable assembly is contained; however, the hat is shown in FIG. 7 with the rows of teeth fully unzipped prior to insertion of the cable assembly. As will be described below, a zipper slider 37 is typically used to join the upper and lower rows but once the rows are joined and the cable assembly contained, the slider is removed and the abutting ends of the zipper rows permanently fused and/or bonded together.

In variations other channel closures other than a zipper assembly can be utilized. For instance, a hook and loop closure could be utilized, or the fabric could be sewn to produce the annular channel. Buttons and other mechanical fasteners could also be utilized to close the channel as well as thermoplastic fusing or adhesive bonding. In some variations, the channel need not be continuous but can comprise, for instance, a plurality of sleeves distributed along the perimeter wherein exposed sections of the cable assembly extend between the spaced sleeves.

Figure 6:
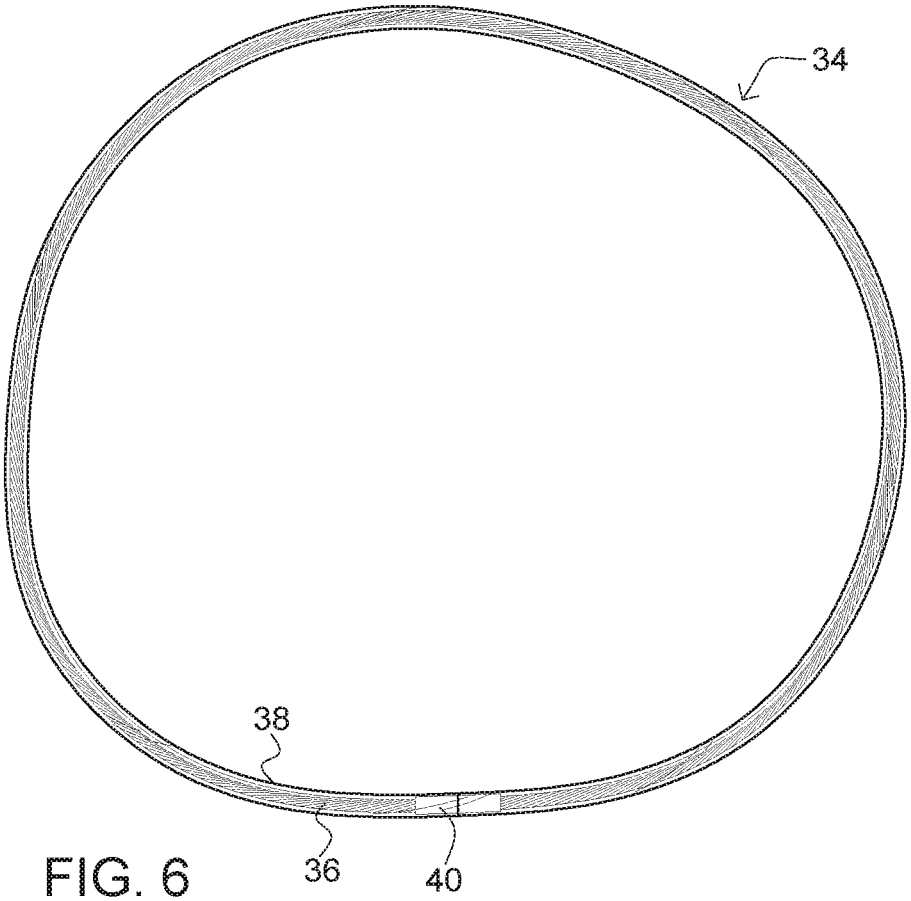
FIG. 6 is a perspective view of a wire cable assembly used in the brim of the sun hat according to an embodiment of the present invention.
Figure 8A:
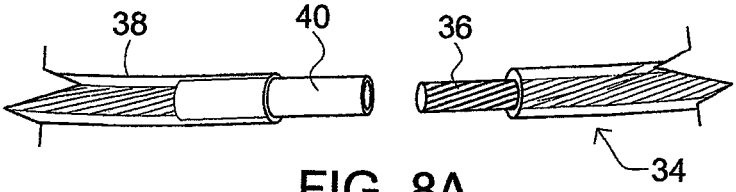
FIGS. 8A&B are partial cross sectional side views of the wire cable assembly both before and after being formed into a loop according to an embodiment of the present invention.
Figure 8B:
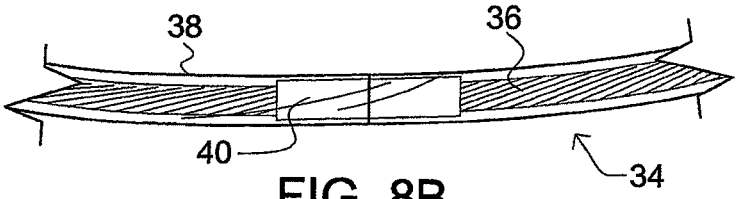

With reference to FIGS. 6, 8*a* & 8*b*, the annular wire cable assembly 34 typically comprises a multi-strand wire cable 36 fully encased in a flexible plastic sheath 38. The ends of the wire cable and the sheath are joined using a coupling sleeve 40 to create a ring and seal the wire cable from exposure to water.

In the illustrated embodiment, the wire cable 36 comprises multiple strands of copper wire or filament that are twisted to form a multi-strand cable. The wire cable is comprised of (i) at least 8 strands, (ii) more preferably between 9 and 14 strands and (iii) most preferably between 15 and 24 strands, and has an American Wire Gauge (AWG) of 4 to 12. In one variation, the multi-strand cable comprises 19 individual 7 mm diameter wires twisted together and having an aggregate AWG of 8. The copper wire used in the cable is typically fully annealed and 99.9% pure.

In variations, the cable can comprise a metallic material other than copper, such as annealed aluminum or even titanium. Additionally, solid core metal wire or ribbon can be used instead of multi-strand wire cable. For instance, where a metal ribbon is utilized it can be secured to the top or bottom surfaces of the brim 14 proximate the perimeter.

The cable 36 is typically encased in a flexible plastic sheath 38. The sheath can comprise any suitable material that posses the necessary resilience and flexibility to not develop cracks, tears or holes when subject to repeated bending and manipulation. One suitable material comprises a flexible vinyl plastic. Another suitable material comprises a ether-based polyurethane having a shore A hardness of about 85. The inner diameter of the sheath is typically greater than the outside diameter of the cable to be received therein by a sufficient amount such that the cable can be relatively easily slid into the tubular sheath during cable assembly fabrication. Additionally, the larger inner diameter of the sheath compared to the cable permits repeated bending of the cable assembly without the metal cable itself putting undue additional strain on the sheath through close intimate contact therewith.

Variations of the sheath are contemplated. For instance, the sheath could be tightly formed against the metal cable through the use of heat shrink tubing, the direct coating of the cable with a liquid plastic material or by any other suitable means. In yet other variations, the sheath may be dispensed with entirely. A cable comprising a corrosion resistant metal may be used or the cable may be plated with a protective metallic coating such as chrome or zinc plating.

The lengths of both the wire cable 36 and the associated sheath 38 share substantially similar lengths in the cable assembly 34. In the embodiment illustrated in FIG. 8*a*&*b*, both the metal cable and the sheath are joined into a ring by way of the coupling sleeve 40. The coupling sleeve is typically comprised of a substantially rigid plastic material but can comprise metal or other suitable materials as well. The sleeve has an inner diameter substantially similar to or even slightly less than the outside diameter of the metal cable. Further, the sleeve an outside diameter that is substantially similar or slightly greater than the inside diameter of the sheath. Accordingly, the cable assembly is joined into a ring by securing the ends of the wire cable tightly within the sleeve while securing the sheath tightly over the outside of the sleeve. When the sheath's inside diameter is sized properly relative to the outside diameter of the sleeve, a water impervious seal is formed effectively protecting the wire cable from exposure to the elements.

While in the illustrated embodiment, the sleeve 40, sheath 38 and wire cable 36 are all joined into the ringed assembly without the use of adhesives or any other extraneous mechanical implements, variations are contemplated wherein adhesives and/or mechanical fasteners are utilized alone or in combination with a sleeve. For instance, the metal cable can be clamped, brazed or welded, and the sheath can be adhesively joined and/or thermoplastically welded.

Methods of Using a Hat with a Bendable Brim

The hat 10 shown in the various figures can be used in any suitable manner; however, unlike prior art hats the brim 12 of the hat can be bent to change the style of the hat, enhance its functionality and/or facilitate storage. FIGS. 5A-E provide several illustrations showing only some of the possible configurations of embodiments of the hat.

Figure 5A:
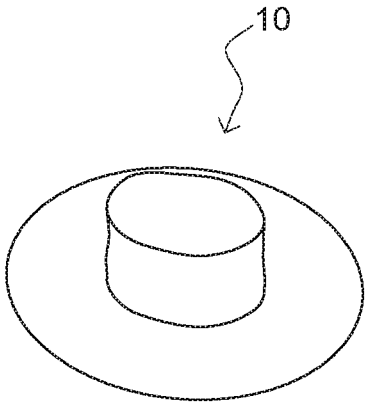
FIG. 5A-e illustrate the sun hat with the brim bent into a variety of shapes according to an embodiment of the present invention.

FIG. 5A shows the hat 10 with a traditional flat brim 14. As can be appreciated, the hat's brim cab be reshaped from one shape, such as the flat brim, to any other shape repeatedly. In preferred embodiments, the brim can be reshaped at least 1000 times, more preferably more than 2000 times and most preferably more than 4000 times.

Figure 5B:
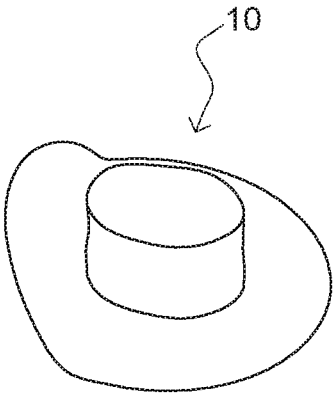

FIG. 5B shows the hat 10 with the back side of the brim 12 turned sharply upwardly. This configuration can be utilized when backpacking so that the brim of the hat does not interfere with the top of the wearer's backpack.

Figure 5C:
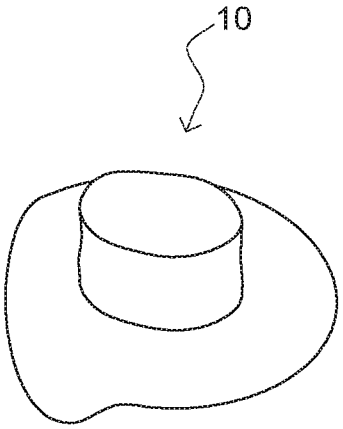

FIG. 5C shows the hat 10 with the back side of the brim 12 turned sharply downwardly. This configuration can be utilized when the wearer desires greater protection of the back of the neck from the Sun.

Figure 5D:
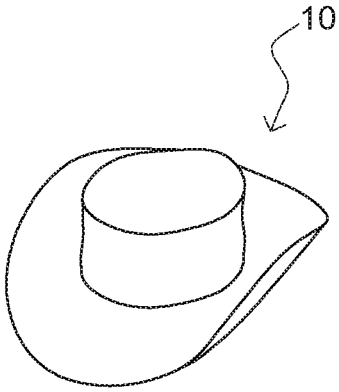

FIG. 5D shows the hat 10 with the left and right sides of the brim 12 rolled upwardly giving the hat a look reminiscent of a cowboy hat. Of course, many different hat styles may be emulated by bending the brim in a desired manner.

Figure 5E:
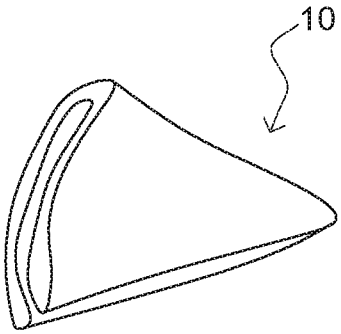

FIG. 5E shows the brim 12 and the hat 10 folded into quarters making it particularly compact for storage in a purse or bag. To use the hat after storage, it simply unfolded and the brim is shaped to the user's desired configuration.

A Method of Fabricating a Hat with a Bendable Brim

Embodiments of the hat 10 are largely made using traditional and known means except for the construction of the looped cable assembly and the placement and securement of the assembly around or proximate the perimeter of the hat's brim 12.

As described above, the perimeter of the brim as shown in FIG. 7 is characterized by upper and lower rows of mating zipper teeth 30&32 that when joined form an enclosed channel 33 wherein the cable assembly 34 is received. In fabrication, a zipper slide 36 is attached to the rows allowing a fabricator to mesh and unmesh respective teeth of the upper and lower rows.

The cable assembly 34 is fabricated in a manner essentially described above. Both the sheath 38 and the wire cable 36 are cut to substantially the same length. One end of the cable is tightly pressed about halfway into the coupling sleeve 40 securing it in place. The cable is then threaded through the flexible sheath. The end of the sheath corresponding to the end of the cable having the coupling sleeve thereon is slid halfway over the sleeve. This configuration is shown in FIG. 8A. Next, to join the ends and complete the looped cable assembly, the other ends of the cable and sheath are simultaneously fed and pushed respectively into and over exposed end of the sleeve.

Figure 9A:
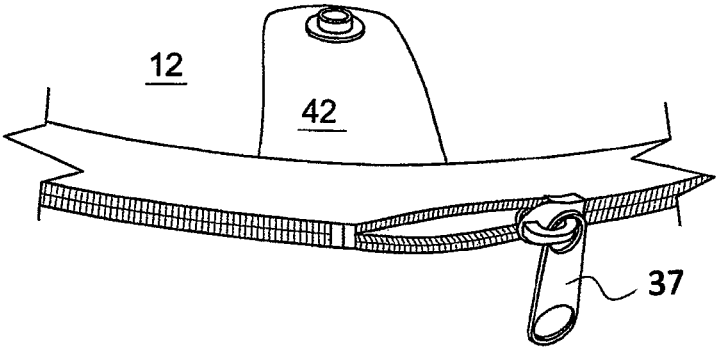
FIG. 9A is a partial perspective top view of the rear edge of the brim illustrating where the ends of the zipper meet according to an embodiment of the present invention.
Figure 9B:
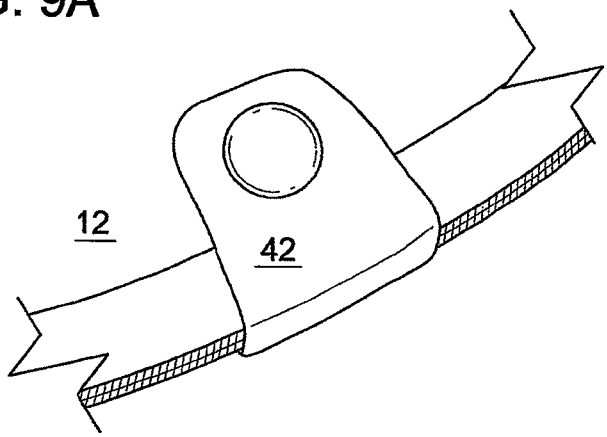
FIG. 9B is a partial perspective bottom view of the rear edge of the brim illustrating where the ends of the zipper meet and are covered by a fabric flap according to an embodiment of the present invention.

The completed cable assembly 34 is placed in the brim's perimeter channel 33 and the fabricator uses the slide to join substantially all the upper and lower teeth 30&32. In the illustrated variation, the slide 36 is then slid off of the joined teeth at a location typically to the back of the brim and the teeth are fused and/or adhesively bonded in place at both facing ends of the rows of teeth to permanently close the channel and secure the cable assembly therein. In variations, the slide can be left in place providing access to the cable if need be. In the illustrated embodiment a flap 42 is provided as shown in FIGS. 9A&B that can be folded over the adjoining ends of the zipper rows and snapped or otherwise secured in place to give the hat a more finished look.

OTHER EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A hat, the hat comprising:

a crown;

a brim extending annularly and completely around the crown, the brim including an annular brim perimeter, and a channel extending along substantially an entirety of the brim perimeter, the channel including a zipper chain extending along the channel; and a wire cable assembly enclosed in the channel, the wire cable assembly comprising one or more strands of a metallic wire, a flexible polymeric sheath over the one or more strands of the metallic wire, and a coupling sleeve joining respective ends of the flexible polymeric sheath together to create a loop.

2. The hat of claim 1, wherein the respective ends and the coupling sleeve form a water tight seal.

3. The hat of claim 1, wherein the coupling sleeve comprises a polymeric material.

4. The hat of claim 1, wherein the one or more strands of the metallic wire comprises multiple strands of metallic wire.

5. The hat of claim 1, wherein (i) abutting ends of the zipper chain are one of permanently fused, adhesively bonded and mechanically fixed, and (ii) the zipper chain does not include a zipper slide.

6. A method of using the hat of claim 1, the method comprising:

forming the brim into a first shape and wearing the hat with the brim in the first shape; and forming the brim of the hat into a second shape and wearing the hat with the brim in the second shape.

7. The method of using the hat of claim 6, further comprising folding the brim into quarters and stowing.

8. A hat, the hat comprising:

a crown;

a brim extending annularly and completely around the crown, the brim including an annular brim perimeter, and a channel extending along substantially an entirety of the brim perimeter, the channel including a zipper chain extending along the channel; and a wire cable assembly enclosed in the channel, the wire cable assembly comprising multiple strands of a metallic wire, a flexible polymeric sheath over the one or more strands of the metallic wire, and a polymeric coupling sleeve joining respective ends of the flexible polymeric sheath together to create a loop and form a water tight seal.

* * * * *